US010267280B2

(12) United States Patent
Pasquali et al.

(10) Patent No.: US 10,267,280 B2
(45) Date of Patent: Apr. 23, 2019

(54) FUEL DELIVERY ASSEMBLY FOR AN INTERNAL COMBUSTION ENGINE

(71) Applicant: CONTINENTAL AUTOMOTIVE GMBH, Hannover (DE)

(72) Inventors: Marco Pasquali, Leghorn (IT); Massimo Latini, Empoli (IT); Andrea Puccini, San Miniato (IT)

(73) Assignee: CPT GROUP GMBH, Hannover (DE)

( * ) Notice: Subject to any disclaimer, the term of this patent is extended or adjusted under 35 U.S.C. 154(b) by 0 days.

(21) Appl. No.: 15/595,166

(22) Filed: May 15, 2017

(65) Prior Publication Data

US 2017/0342952 A1 Nov. 30, 2017

(30) Foreign Application Priority Data

May 24, 2016 (EP) ..... 16171039

(51) Int. Cl.
*F02M 61/14* (2006.01)
*F02M 55/00* (2006.01)
(Continued)

(52) U.S. Cl.
CPC ..... *F02M 61/145* (2013.01); *F02M 55/005* (2013.01); *F02M 55/025* (2013.01); *F02M 61/168* (2013.01); *F02M 61/205* (2013.01); *F02M 55/02* (2013.01); *F02M 61/14* (2013.01); *F02M 61/16* (2013.01);
(Continued)

(58) Field of Classification Search
CPC ..... F02M 2200/853; F02M 2200/856; F02M 61/145; F02M 55/005; F02M 55/025; F02M 61/168; F02M 61/205; F02M 55/02; F02M 61/16; F02M 2200/8023; F02M 61/14
See application file for complete search history.

(56) References Cited

U.S. PATENT DOCUMENTS 5,035,224 A 7/1991 Hornby et al.
5,394,850 A 3/1995 Murphy et al.
(Continued)

FOREIGN PATENT DOCUMENTS

JP 2013050109 A 3/2013
KR 1020040049942 A 6/2004

OTHER PUBLICATIONS

European Patent Office Search Report dated Sep. 16, 2016 for corresponding European application No. 16171039.7.
(Continued)

*Primary Examiner* — Hung Q Nguyen
*Assistant Examiner* — Xiao Mo

(57) ABSTRACT

A fuel delivery assembly for an internal combustion engine, including an injector cup, a fuel injector received therein, and a spring clip is disclosed. The injector cup has a circumferential wall with an external shoulder. The fuel injector has a shoulder which is axially spaced apart from the injector cup. The spring clip has a base portion with two radially compliant webs bearing against the shoulder of the circumferential wall and being in force-fit engagement with the circumferential wall. The spring clip has an axially compliant portion bearing against the shoulder of the fuel injector and being elastically deformable to bias the fuel injector in axial direction from the upper end towards the lower end.

6 Claims, 4 Drawing Sheets

(51) Int. Cl.
*F02M 61/20* (2006.01)
*F02M 55/02* (2006.01)
*F02M 61/16* (2006.01)

(52) U.S. Cl.
CPC ..... *F02M 2200/8023* (2013.01); *F02M 2200/853* (2013.01); *F02M 2200/856* (2013.01)

(56) References Cited

U.S. PATENT DOCUMENTS

| | | | | |
|---|---|---|---|---|
| 6,668,803 | B1 * | 12/2003 | McClean ..... | F02M 61/14 123/456 |
| 2002/0139353 | A1 | 10/2002 | Makiyama | |
| 2010/0300406 | A1 | 12/2010 | Harvey et al. | |

OTHER PUBLICATIONS

Korean Office Action dated Jul. 20, 2018 for corresponding Korean application No. 10-2017-0062431.
Korean Notice of Allowance dated Dec. 26, 2018 for corresponding Korean application No. 10-2017-0062431.

* cited by examiner

FUEL DELIVERY ASSEMBLY FOR AN INTERNAL COMBUSTION ENGINE

CROSS REFERENCE TO RELATED APPLICATIONS

This U.S. patent application claims the benefit of European patent application No. 16171039.7, filed May 24, 2016, which are hereby incorporated by reference herein.

FIELD OF INVENTION

The present disclosure relates to a fuel delivery assembly and to a method for assembling the fuel delivery assembly.

SUMMARY

It is an object of the present disclosure to specify an improved fuel delivery assembly.

According to one aspect of the present disclosure, a fuel delivery assembly for an internal combustion engine is disclosed. According to a further aspect of the present disclosure, a method for assembling the fuel delivery assembly is disclosed.

The fuel delivery assembly comprises a fuel injector and an injector cup. In one embodiment, the fuel delivery assembly further comprises a fuel rail, which is in particular an elongated tube representing a fuel reservoir. The fuel injector may be hydraulically and mechanically connected to the fuel rail via the injector cup.

The injector cup extends along a longitudinal axis from an upper end to a lower end. In this context, the upper end and the lower end are in particular in opposite axial ends of the injector cup.

The injector cup has a circumferential wall. The circumferential wall extends around the longitudinal axis. Adjacent to the lower end, the injector cup has an opening which is in particular formed by the circumferential wall. Further, the injector cup may expediently have a fuel inlet opening, preferably adjacent to the upper end. The fuel inlet opening of the injector cup is preferably hydraulically connected to an outlet port of the fuel rail. For example, the injector cup is brazed directly to the fuel rail so that the fuel inlet opening of the injector cup and the outlet port of the fuel rail overlap or a pipe is arranged between the outlet port of the fuel rail and the fuel inlet opening of the injector cup.

A fuel inlet portion of the fuel injector is received in the injector cup such that the fuel injector projects from the injector cup through the opening. More specifically, the injector cup in particular has a recess which is shaped by the circumferential wall and extends from the opening towards the upper end—in particular to the fluid inlet opening—and the fuel inlet portion of the fuel injector is positioned inside the recess of the injector cup.

According to one embodiment, the fuel delivery assembly further comprises a spring clip. For example in this embodiment, the circumferential wall of the injector cup preferably has an external shoulder. The fuel injector preferably also has a shoulder, the shoulder of the fuel injector being axially spaced apart from the injector cup.

In one development, the spring clip has a base portion with two radially compliant webs. In particular, the webs are flexible in radial direction so that they are elastically deformable for engaging and disengaging around the circumferential wall of the injector cup. For example, an axial extension of the webs is at least twice as large, preferably at least four times as large as their thickness perpendicular to the axial extension.

The webs bear against the shoulder of the circumferential wall to prevent displacement of the base portion in axial direction towards the upper end with respect to the injector cup. Additionally, the webs are preferably in force-fit engagement with the circumferential wall of the injector cup to prevent displacement of the base portion with respect to the injector cup in axial direction towards the lower end.

Further, the spring clip may have an axially compliant portion bearing against the shoulder of the fuel injector. The axially compliant portion is elastically deformable—and in some embodiments is elastically deformed at least in the assembled state of the fuel delivery assembly—to bias the fuel injector in axial direction from the upper end towards the lower end. Specifically, the spring clip, the shoulder of the circumferential wall of the injector cup and the shoulder of the fuel injector may be configured and arranged for axially and elastically deforming the compliant portion of the spring clip for biasing the fuel inlet portion of the fuel injector in said axial direction, i.e., in direction out of the recess of the injector cup.

With advantage, in a method for assembling the fuel delivery assembly, the spring clip can be fixed to the injector cup before shifting the fuel inlet portion of the fuel injector into the recess of the injector cup. Assembly of the fuel delivery assembly and/or installation of the fuel delivery assembly with the engine may be particularly easy in this way. In particular, the spring clip of may advantageously be in a fix position relative to the injector cup for assembling the injector cup and the fuel injector.

In one embodiment, the fuel delivery assembly comprises a clamp in addition or alternatively to the spring clip. In this embodiment, the injector cup preferably has two slots which perforate the circumferential wall, in particular on opposite sides in a side view of the injector cup. In one development, the slots are arranged axially between the shoulder of the circumferential wall and the opening at the lower end of the injector cup.

The clamp has two legs. The legs may extend through the slots. Preferably, each leg is positioned in one of the slots. In this way, axial displacement of the clamp with respect to the injector cup in direction towards the lower end is blocked, in particular by means of a form fit engagement between the legs and an axially facing surface portion of the circumferential wall delimiting the slots.

The fuel inlet portion may expediently have one or more radial protrusion(s) which bear(s) on the legs of the clamp so that the clamp blocks axial displacement of the fuel injector with respect to the clamp in axial direction from the upper end towards the lower end. In particular, the legs of the clamp are positioned axially between the protrusion (s) and the axially facing surface portion of the slots. In this way, the clamp blocks axial displacement of the fuel inlet portion in direction out of the recess of the injector cup by means of mutual mechanical interaction of the radial protrusion of the fuel injector with the clamp and of the clamp with the circumferential wall of the injector cup.

With advantage, by means of the clamp, the injector may be secured in the injector cup. Preferably, by means of the clamp, the injector is advantageously retained in an axial position such that the spring clip is preloaded and presses the radial protrusion (s) of the fuel inlet portion against the clamp in axial direction.

In one embodiment, the base portion of the spring clip is arranged axially between the slots and the shoulder of the circumferential wall. In a further embodiment, the axially compliant portion is—alternatively or additionally—arranged axially between the slots and the shoulder of the fuel injector. In this way, a particularly compact size of the fuel delivery assembly is achievable.

In one embodiment, the base portion of the spring clip has a partial annular shape formed by the webs. In another embodiment, the clamp is generally U-shaped. In one development, the partial annular shape of the base portion of the spring clip is open in a first radial direction and the U-shape of the clamp is open in a second radial direction, opposite to the first radial direction. In this way, a particularly small radial extension of the fuel delivery assembly is achievable.

In one embodiment, the base portion of the spring clip has a flattening which engages with a flat surface region of the circumferential wall. The flattening is preferably arranged between the two webs in a circumferential direction. In this way, a simple and precise angular orientation of the spring clip relative to the injector cup is achievable.

In one embodiment, each of the webs of the base portion of the spring clip is in full-area contact with the circumferential wall over an angular range of at least 45°. In other words, each of the webs preferably has an inner circumferential surface portion and the circumferential wall of the injector cup has corresponding external surface portions which are in full area contact with the inner circumferential surface portions of the webs over an angular range of at least 45°. Preferably, each of the surface portions has upper and lower edges in the shape of a circular arc and extending over an angle of at least 45° around the longitudinal axis. In this way, a particular good force-fit connection between the base portion of the spring clip and the circumferential wall of the injector cup is achievable.

In one embodiment, the spring clip is a one-piece sheet-metal part. In this way, the spring clip is easily and cost-effectively manufacturable.

Further advantages, advantageous embodiments and developments of the fuel delivery assembly and the method for assembling it will become apparent from the exemplary embodiment which is described below in association with schematic figures.

DETAILED DESCRIPTION

In the exemplary embodiments and figures, similar, identical or similarly acting elements are provided with the same reference symbols. In some figures, individual reference symbols may be omitted to improve the clarity of the figures.

Figure 1:
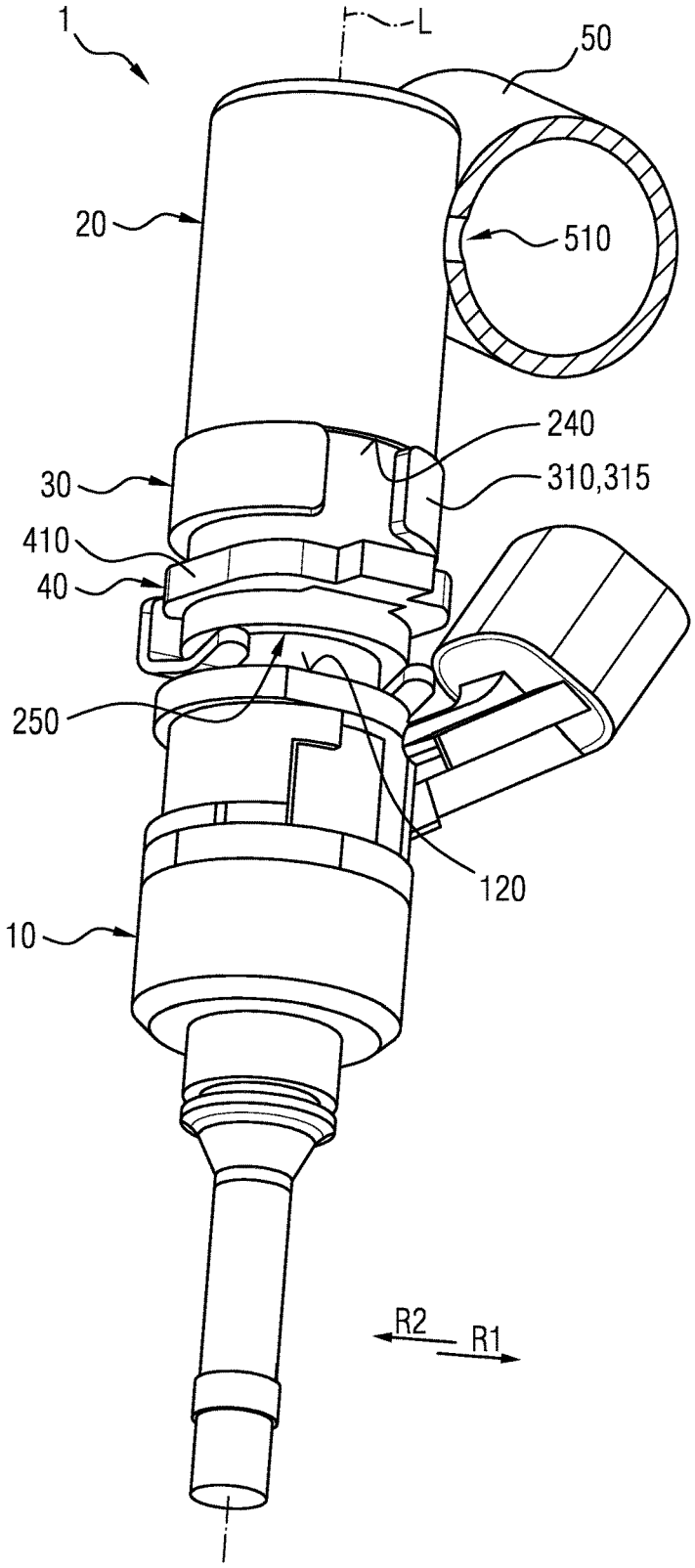
FIG. 1 shows a perspective view of a portion of a fuel delivery assembly according to an exemplary embodiment.

FIG. 1 shows, in a perspective view, a fuel delivery assembly 1 comprising a fuel rail 50 in the shape of an elongated tube. The fuel rail 50 is cut open for the view of FIG. 1. In this way, an outlet port 510 is visible which hydraulically connects the fuel rail 52 and the injector cup 20 which is brazed and/or welded to an outer circumferential surface of the fuel rail 50.

Figure 2:
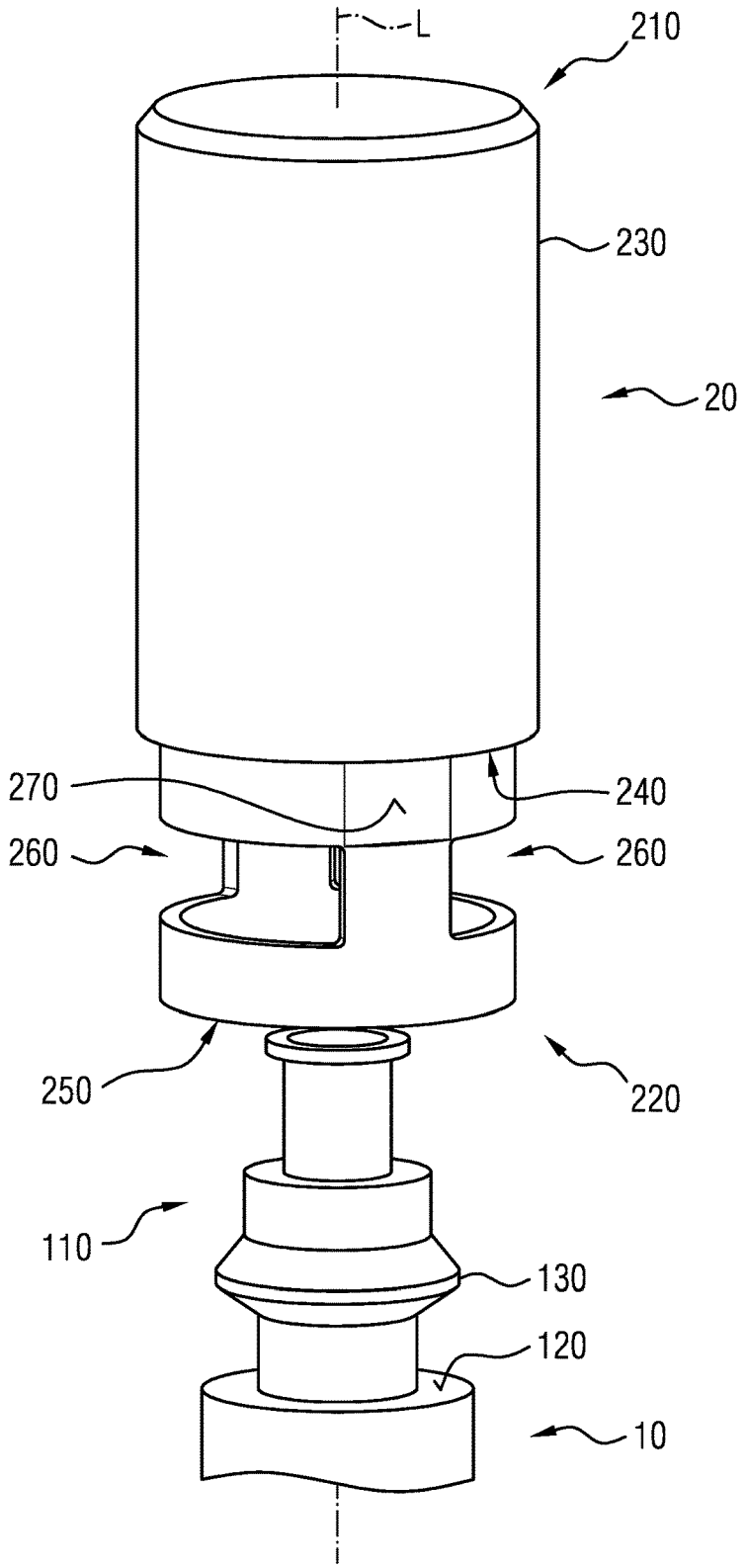
FIG. 2 shows a perspective view of an injector cup and a fuel injector of the fuel delivery assembly in a disassembled state.

The injector cup 20 is shown in an unassembled state in the perspective view of FIG. 2. It extends from an upper end 210 along a longitudinal axis L to the lower end 220.

The injector cup 20 is hollow. It has a circumferential wall 230 which extends from the upper end 210 to the lower end 220 and forms a recess of the injector cup 20. Adjacent to the lower end 220, the recess ends in an opening 250. Adjacent to the upper end 210, the injector cup 20 has a fuel inlet opening (not visible in the figures) which perforates the circumferential wall 30 for hydraulically coupling the recess to the fuel rail 50 via the outlet port 510 of the fuel rail 50.

Through the opening 250, a fuel injector 10 is shifted into the recess of the injector cup 20 so that a fuel inlet portion 110 of the fuel injector 10 is arranged in the recess. The fuel inlet portion 110 of the fuel injector 10 is also shown in FIG. 2 in a state before it is received in the injector cup 20 in.

The fuel injector 10 projects from the injector cup 20 in a first axial direction which is directed from the upper end 210 towards the lower end 220 of the injector cup 20. The fuel injector 10 is, for example, configured for injecting fuel directly into a combustion chamber of an internal combustion engine.

In the present embodiment, the circumferential wall 230 of the injector cup 20 is perforated adjacent to the lower end 220 by two slots 260. The slots 260 are arranged in mirror symmetrical fashion with respect to a plane comprising the longitudinal axis L. The slots 260 are each delimited by two surfaces which extend parallel to the longitudinal axis L and by two circumferentially extending surfaces which face in the first axial direction and in a second axial direction, opposite to the first axial direction.

The fuel inlet portion 110 of the fuel injector 10 has a radial protrusion 130. In the present embodiment, the radial protrusion 130 is a circumferential flange which protrudes from a generally cylindrical outer surface of the fuel inlet portion 110 in the present embodiment. In the assembled state of the fuel delivery assembly 1, the protrusion 130 of the fuel inlet portion 110 is axially offset in the second axial direction at least with respect to a portion of the slots 260, specifically with respect to the circumferentially extending surface which faces in the second axial direction.

Figure 3:
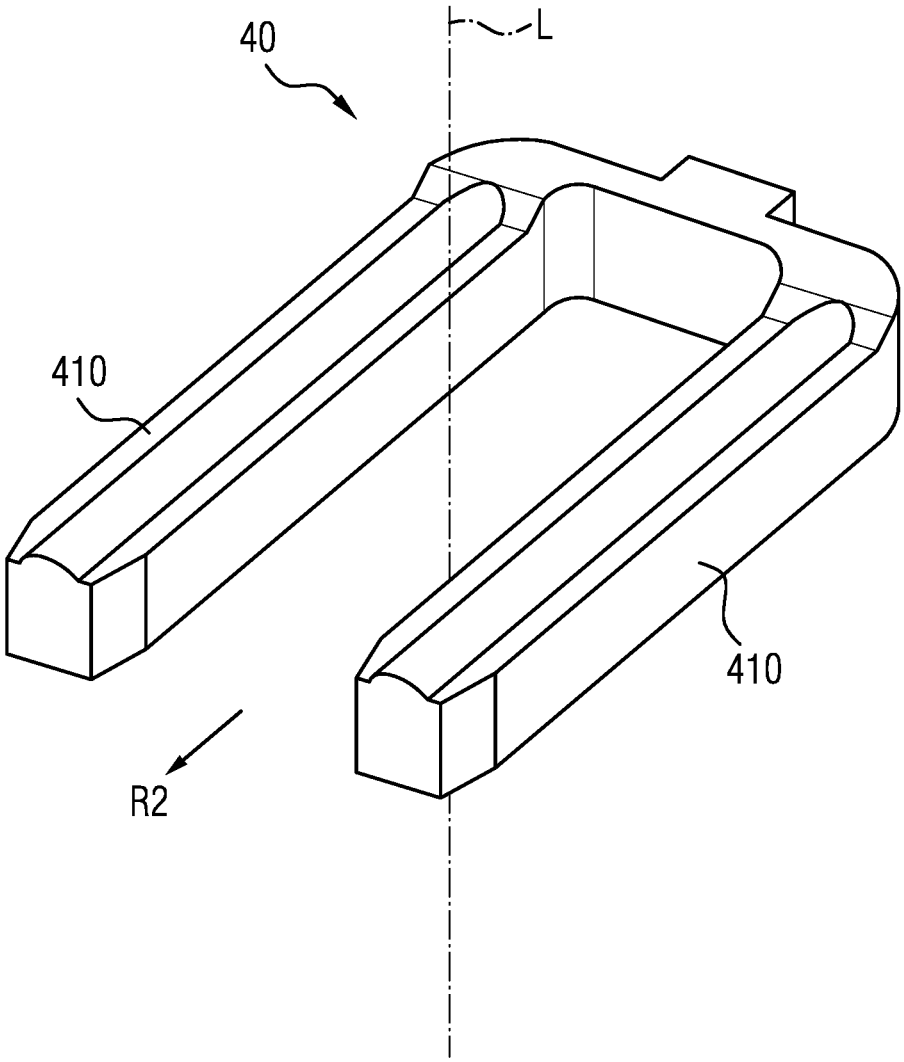
FIG. 3 shows a perspective view of a clamp of the fuel delivery assembly.

The fuel delivery assembly 1 further comprises a clamp 40 which is shown separately in FIG. 3. The clamp 40 is generally U-shaped and has two parallel legs 410. Each leg 410 is positioned in one of the slots 260. The legs 410 are in form-fit connection with the circumferentially extending surfaces of the slots 260 which face in the second axial direction. Thereby, axial displacement of the clamp 40 with respect to the injector cup 20 in the first axial direction is blocked. The radial protrusion 130 of the fuel inlet portion 110 of the fuel injector 10 is in form-fit connection with both legs 410 at a side of the legs 410 which faces towards the upper end 210 of the injector cup 20. In this way, axial displacement of the fuel injector 10 with respect to the clamp 40 is blocked in the first axial direction. Consequently—by the form fit connection of the clamp 40 with the circumferential wall 230—axial displacement of the fuel injector 10 in the first axial direction is also blocked with respect to the injector cup 20.

Figure 4:
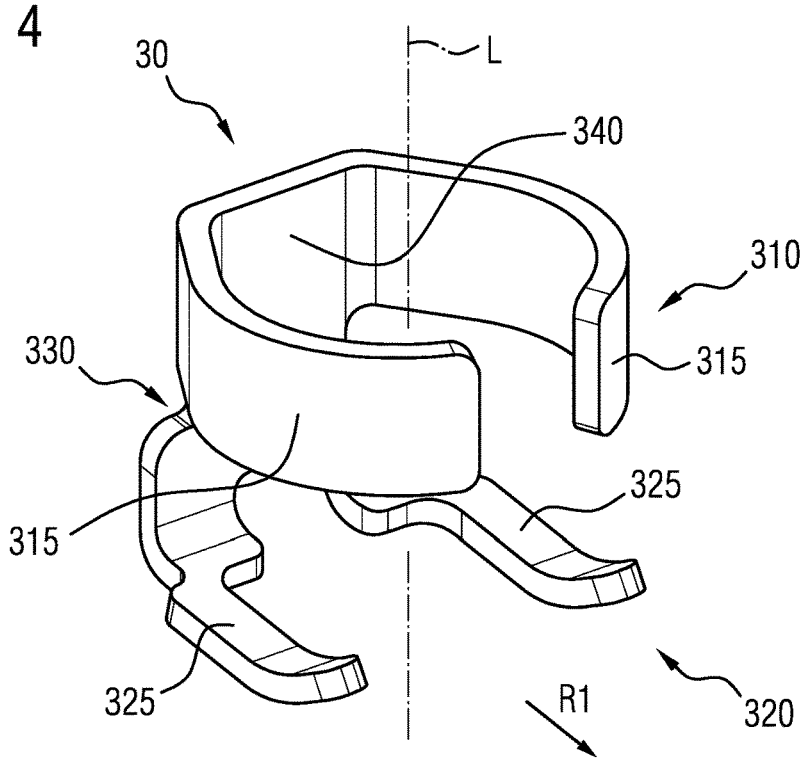
FIG. 4 shows a perspective view of a spring clip of the fuel delivery assembly.
Figure 5:
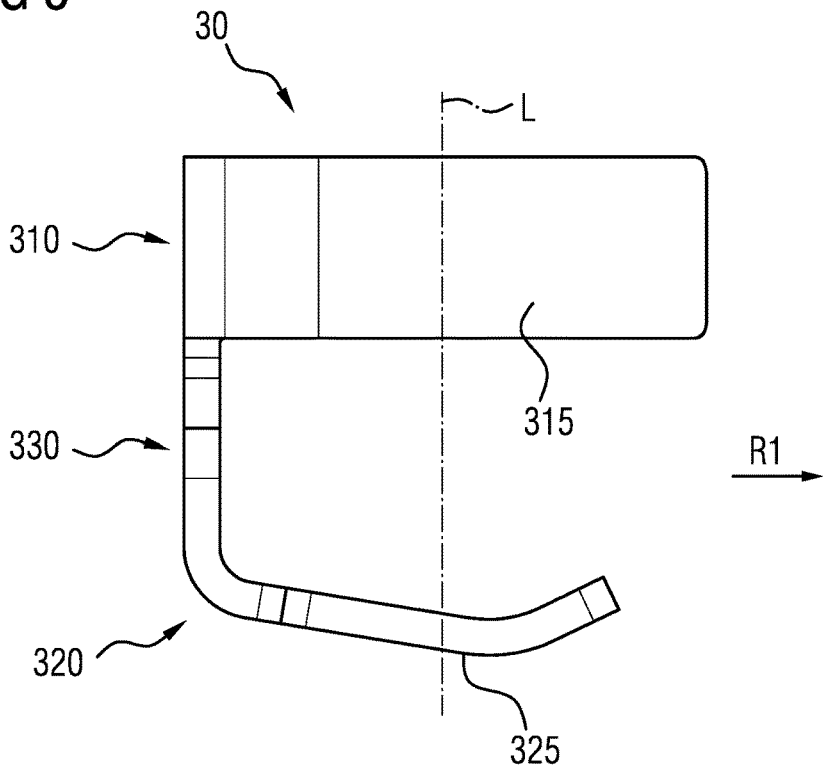
FIG. 5 shows a side view of the spring clip.

The fuel delivery assembly 1 of the present embodiment further comprises a spring clip 30, shown separately in a perspective view in FIG. 4 and in a side view in FIG. 5. The spring clip 13 is a one-piece sheet-metal part which has a base portion 310, a connection portion 330 and an axially compliant portion 320 which follow one another in this order in the first axial direction. The connection portion 330 in particular rigidly connects the base portion 310 and the axially compliant portion 320.

The base portion 310 has two radially compliant webs 315 which engage around the circumferential wall 230. The thickness of the webs 315—i.e., the material thickness in radial direction—corresponds to the thickness of the sheet metal from which the spring clip 30 is manufactured. The longitudinal extension of the webs 315 is about 4 to 5 times as large as the material thickness in radial direction so that the webs 315 are elastically deformable in radial direction and rigid in axial direction.

The base portion 310 is shaped such that, in the assembled state, the radially compliant webs 315 are elastically deformed in radially outward direction. Further, the shape of an inner circumferential surface portion of the webs 315 matches the shape of the circumferential wall 230 so that the inner circumferential surface portions are in full area contact with the circumferential wall 230, in particular over an angular range of at least 45° for each web 315. In this way, a press-fit connection is established between the base portion 310 and the circumferential wall 230 of the injector cup 20 for preventing displacement of the base portion 310 in the first axial direction.

Between the webs 315, the base portion 310 has an interconnection portion extending circumferentially from one of the webs 315 two the other one of the webs 315 for connecting the webs 315 to one another. The interconnecting portion has a flattening or flattened section 340 which is in full area contact with flat surface region 270 of the circumferential wall 234. In this way, the angular position of the spring clip 30 relative to the injector cup 20 is set, i.e., indexing of the spring clip 30 relative to the injector cup 20 is achieved.

Remote from the interconnection portion, the webs 315 have free ends so that the base portion 310 has a partial annular general shape, formed by the webs 315 and in the present embodiment also by the interconnection portion. The partial annular shape is open in a first radial direction R1.

The U-shaped clamp 40 is open in a second radial direction R2, opposite to the first to the direction R1. In this way, the free ends of the legs 410 of the clamp 40 face towards the interconnection portion of the base portion 310 of the spring clip 30 and the free ends of the webs 315 face towards the closed end of the U-shape of the clamp 40.

The base portion 310 of the spring clip 30 is arranged axially subsequent to the slots 260 in a direction towards the upper end 210 of the injector cup 20, i.e., in the second axial direction. Subsequent to the base portion 310 in the second axial direction, the circumferential wall 230 has an external shoulder 240. In the present embodiment, the circumferential wall 230 has a first portion adjacent to the upper end 210 having a first diameter and a second portion adjacent to the lower end 220 having a second diameter, the second diameter being smaller than the first diameter. An interface between the first and second portions is represented by the shoulder 240, being embodied as a step of the external surface of the circumferential wall 230 in the present embodiment.

The webs 315 of the base portion 310 of the spring clip 30 bear against the shoulder 240. In this way, axial displacement of the base portion 310 in the second axial direction is blocked by form fit engagement between the webs 315 and the shoulder 240.

The fuel injector 10 also has a shoulder 120, being axially spaced apart from the injector cup 20 in the first axial direction. In particular, the shoulder 120 is positioned subsequent to the fuel inlet portion 110 in the first axial direction on the fuel injector 10. For example, the shoulder 120 of the fuel injector 10 is a step of a housing of the fuel injector 10. The axially compliant portion 320 of the spring clip 30 bears against the shoulder 120 of the fuel injector 10.

Specifically, in the present embodiment, the axially compliant portion 320 has two axially compliant webs 325 which are curved and/or kinked such that they each have a contact region which is in contact with the shoulder 120 and laterally arranged between a free first end and a second end which merges with the connection portion 330. The first and second ends are spaced apart from the shoulder 120 of the fuel injector 10, i.e., they are axially displaced in the second axial direction with respect to the contact region. The material thickness of the axially compliant webs 325 corresponds in particular to the thickness of the sheet-metal from which the spring clip 30 is manufactured.

The axial positions of the shoulder 120 of the fuel injector 10, shoulder 240 of the injector cup 20, as well as the axial positions and dimensions of the clamp 40, the slots 260 of the injector cup 20, and the radial protrusion 130 of the fuel inlet portion 110 of the fuel injector 10 are selected such that the axially compliant webs 325 of the axially compliant portion 320 of the spring clip 30 are elastically deformed when the fuel delivery assembly 1 is assembled. This way, the spring clip 30 presses the radial protrusion 130 of the fuel injector 10 against the clamp 40 and the clamp 40 against the circumferential wall 230 of the injector cup 20 in axial direction.

One or more embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

The invention claimed is:

1. A fuel delivery assembly for an internal combustion engine, comprising:

a fuel injector having a fuel inlet portion, an injector cup, and a spring clip, wherein the injector cup extends along a longitudinal axis from an upper end to a lower end, has a circumferential wall with an external shoulder, and an opening adjacent to the lower end, the fuel inlet portion of the fuel injector is received in the injector cup such that the fuel injector projects from the injector cup through the opening, the fuel injector has a shoulder which is axially spaced apart from the injector cup, the spring clip has a base portion with two radially compliant webs bearing against the shoulder of the circumferential wall to prevent displacement of the base portion in an axial direction of the injector cup towards the upper end and being in force-fit engagement with the circumferential wall to prevent displacement of the base portion in the axial direction towards the lower end, and the spring clip has an axially compliant portion bearing against the shoulder of the fuel injector and being elastically deformable to bias the fuel injector in the axial direction and the fuel injector from the upper end towards the lower; and a clamp;

wherein the injector cup has two slots which perforate the circumferential wall and are arranged axially between the opening and the shoulder of the circumferential wall; and wherein the clamp has two legs, each leg being positioned in one of the slots so that axial displacement of the clamp with respect to the injector cup in a direction towards the lower end is blocked; and wherein the fuel inlet portion has a radial protrusion which bears on the legs of the clamp so that the clamp blocks axial displacement of the fuel injector with respect to the clamp in the axial direction of the fuel injector from the upper end towards the lower end.

2. The fuel delivery assembly according to the claim 1, wherein the base portion is arranged axially between the slots and the shoulder of the circumferential wall and the axially compliant portion is arranged axially between the slots and the shoulder of the fuel injector.

3. The fuel delivery assembly according to claim 1, wherein the base portion has a partial annular shape formed by the webs and opens in a first radial direction, and the clamp is generally U-shaped and opens in a second radial direction, opposite to the first radial direction.

4. The fuel delivery assembly according to claim 1, wherein the base portion has a flattened section which engages with a flat surface region of the circumferential wall.

5. The fuel delivery assembly according to claim 1, wherein each of the webs is in full-area contact with the circumferential wall over an angular range of at least 45°.

6. The fuel delivery assembly according to claim 1, wherein the spring clip is a one-piece, sheet-metal part.

* * * * *